US006763527B1

(12) United States Patent
Rivoli et al.

(10) Patent No.: US 6,763,527 B1
(45) Date of Patent: Jul. 20, 2004

(54) MEDICAL ASSISTANT OUTER GARMENT

(76) Inventors: Leslie Rivoli, 7239 Hickory Hill La., Cedar Hill, MI (US) 63016; Louis Rivoli, 7239 Hickory Hill La., Cedar Hill, MI (US) 63016

( * ) Notice: Subject to any disclaimer, the term of this patent is extended or adjusted under 35 U.S.C. 154(b) by 0 days.

(21) Appl. No.: 10/389,522

(22) Filed: Mar. 14, 2003

(51) Int. Cl.[7] ..... A41D 1/04
(52) U.S. Cl. ..... 2/250; 2/94
(58) Field of Search ..... 2/114, 51, 69, 2/106, 108, 102, 115, 247–253, 105, 94; 181/131

(56) References Cited

U.S. PATENT DOCUMENTS 3,797,717 A * 3/1974 Collins ..... 224/231
4,369,526 A 1/1983 Clutts
4,637,075 A 1/1987 Ingrisano et al.
4,791,681 A * 12/1988 Dean ..... 2/106
5,072,456 A 12/1991 Elin
5,172,683 A * 12/1992 West ..... 126/263.05
5,265,782 A 11/1993 McNamara
5,440,761 A 8/1995 Abrams et al.
5,451,725 A * 9/1995 Goldman ..... 181/131
5,652,961 A * 8/1997 Knight-Yurt ..... 2/114
5,940,883 A 8/1999 Daoust
6,154,888 A 12/2000 Krohn
6,286,147 B1 * 9/2001 Ingold ..... 2/114
6,308,875 B1 10/2001 Almo

* cited by examiner

*Primary Examiner*—Tejash Patel
(74) *Attorney, Agent, or Firm*—Polster, Lieder Woodruff & Lucchesi, L.C.

(57) ABSTRACT

A medical assistant torso outer garment configured with multiple organizational pockets for securing and carrying medical instruments, including a stethoscope, and health care consumable products in an accessible and logical arrangement. The medical assistant outer garment includes a pair of double pockets which are disposed adjacent the neck opening on left and right sides the garment front. Each double pocket consists of a large pocket sized to receive the binaural portion of a stethoscope, and a small pocket sized to receive the chest portion of the stethoscope, such that both ends of the stethoscope are retained within a respective pocket when the stethoscope is placed around the wearer's neck. At least one organizational pocket assembly is further disposed on the medical assistant outer garment, and includes a large inner pocket with multiple fitted pockets disposed on an outer layer of the large inner pocket. Each of the fitted pockets is sized to receive one or more health care consumable products in an accessible manner.

20 Claims, 6 Drawing Sheets

MEDICAL ASSISTANT OUTER GARMENT

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates to outer garments worn by medical assistants and the like for delivering primary care and emergency treatment to patients, and in particular, to a medical assistant outer garment configured with multiple organizational pockets for securing and carrying medical instruments and health care consumable products in an accessible and logical arrangement.

Medical assistants, such as hospital or trauma center nurses or interns traditionally function in a medical facility to assist a primary physician or medical professional by providing daily patient care and administering directed treatments. To carry out these tasks, a medical assistant often utilizes a limited set of medical instruments, such as bandage scissors, a stethoscope, or a thermometer together with a basic collection of health care consumable products such as alcohol swabs, sterile dressings, surgical tape, and disposable syringes.

Traditional medical assistant's garments, commonly referred to as "scrubs" or "smocks" provide a jacket, vest, or shirt with simple single-compartment left-side and right-side pockets. These pockets do not include any internal partitions or compartments, and hence, items placed therein quickly become jumbled and disorganized, rendering it difficult for the medical assistant to rapidly locate a needed medical instrument or health care consumable product. This can result in wasted time, as it is often easier for the medical assistant to retrieve a needed item from a central supply then it is for the medical assistant to try and carry all of the needed items in the limited pocket space available in a conventional scrub or smock.

Larger items, such as a stethoscope are commonly carried looped over the medical assistant's neck when not in use. Carrying a stethoscope in this manner can become uncomfortable over time, placing a small but continuous strain on the medical assistant's neck. Additionally, a stethoscope loosely hung about a medical assistant's neck is prone to dropping or sliding off during an examination of a patient when the medical assistant may be leaning to one side or bending over.

Several garments for medical personnel have attempted to provide solutions for carrying larger medical instruments, such as stethoscopes, when not in use. For example, U.S. Pat. No. 6,154,888 to Krohn discloses a pair of scrub pants including a single elongated pocket extending down one leg. The pocket of the '888 Krohn patent is designed to hold a fully extended stethoscope when not in use. Alternative garments including components for holding a stethoscope are shown in U.S. Pat. No. 4,637,075 to Ingrisano et al. and U.S. Pat. No. 5,072,456 to Elin. With these garments, the stethoscope is carried about the wearer's neck, in a traditional manner, but is secured along the midline of the wearer's shoulders with a pair of quick release retaining loops, such as Velcro™ strips. While such systems aid in retaining the stethoscope in place, they does not provide for convenient access, as the quick release retaining loops must be released and refastened each time the stethoscope is removed or replaced. In addition, the systems shown in the '075 Ingrisano et al. and '456 Elin patents fail to alleviate the weight of the stethoscope from the wearer's neck, and are prone to permitting the stethoscope to slide around the wearer's neck.

Accordingly, there is a need for a medical assistant's outer garment which provides convenient and easily accessible support for commonly utilized medical instruments, such as a stethoscope carried in a traditional location on the wearer's body, which alleviate at least a portion of the strain associated with carrying such medical instruments, and which include multiple pockets for carrying and organizing commonly utilized health care consumable products in a convenient manner.

BRIEF SUMMARY OF THE INVENTION

Briefly stated, the present invention provides a medical assistant torso outer garment which is configured with multiple organizational pockets for securing and carrying medical instruments, including a stethoscope, and health care consumable products in an accessible and logical arrangement. The medical assistant outer garment preferably includes a pair of double pockets which are disposed adjacent the neck opening, on left and right sides of the front of the garment. Each double pocket consists of an outer pocket sized to receive the binaural portion of a stethoscope, and an inner pocket sized to receive the chest portion of the stethoscope, such that both ends of the stethoscope are retained within a respective pocket when the stethoscope is placed around the wearer's neck. At least one organizational pocket assembly is further disposed on the front or side of the medical assistant outer garment, and includes a large inner pocket and multiple fitted pockets associated with the large inner pocket. Each of the fitted pockets is sized to receive one or more health care consumable products in an accessible manner.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
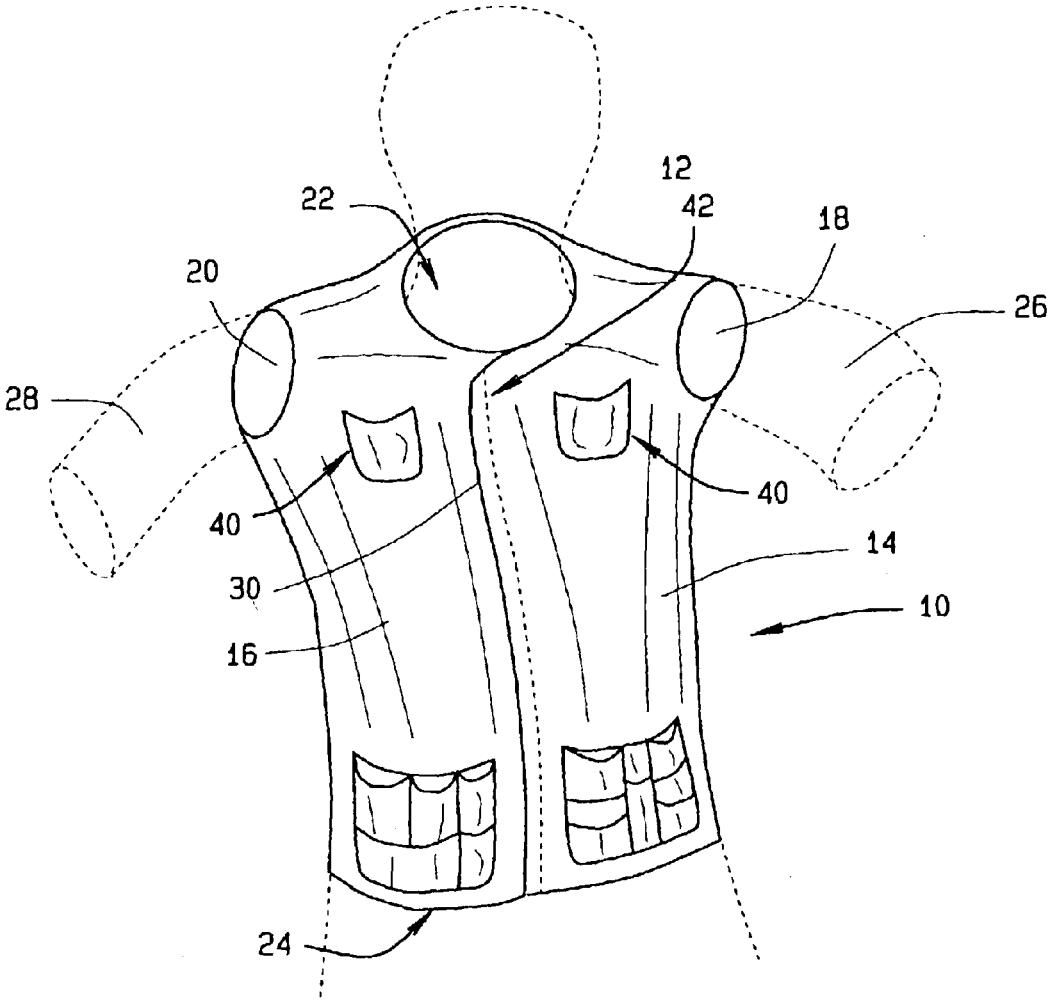
FIG. 1 is a perspective view of a medical assistant outer garment according to the present invention, with optional sleeves and a wearer's torso shown in phantom.

Turning to FIG. 1, an upper body outerwear garment of the present invention for use by medical personnel is shown generally at 10. The outerwear garment includes a back panel 12, a left front panel 14 and a right front panel 16. Preferably, the left front panel 14 and the back panel 12 are secured together along a common peripheral edge. The right front panel 16 is similarly secured to the back panel 12 along a common peripheral edge opposite from the left front panel 14. Alternatively, the left front panel 14, back panel 12, and right front panel 16 may be contiguous in the form of a traditional vest. The configuration of the panels provides left and right arm openings 18, 20, a neck opening 22, and a waist opening 24. Optionally, a left sleeve 26 and a right sleeve 28 may be secured about the left and right arm openings 18, 20.

Preferably, an overlapping placket 30 between the left and right front panels 14, 16 permits the garment 10 to be opened from the neck opening 22 to the waist opening 24. Quick release closure strips 18 line the side edges of the garment 10 below the placket 30 for rapidly opening and closing the garment 10. Alternatively, a zipper closure or sequence of buttons and corresponding button holes may be used for selectively joining and disjoining the sides of the garment 10 in a conventional manner. Optionally, the garment 10 may be configured as a pull-over, with no overlapping placket 30 between the left and right front panels 14, 16.

Figure 2:
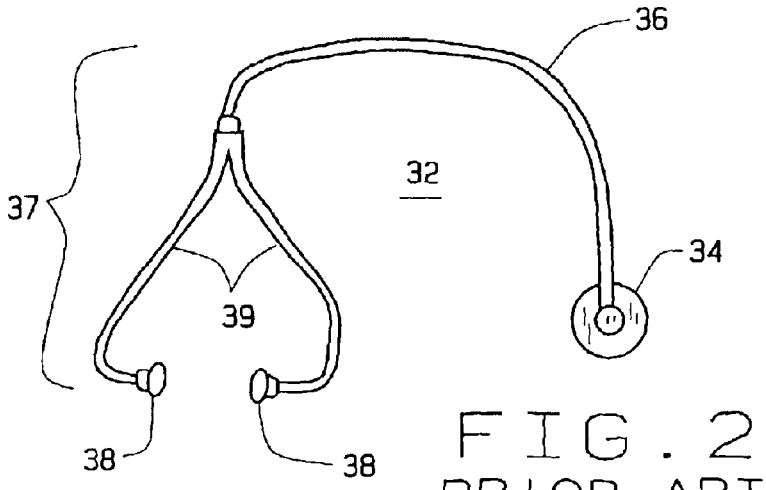
FIG. 2 PRIOR ART
FIG. 2 is a plan view of a prior art stethoscope.

One of the most commonly utilized medical instruments of medical assistants is the stethoscope 32, such as shown in FIG. 2. A stethoscope 32 consists of a chest piece 34, coupled by sound conductive tubing 36 to a binaural portion 37. The binaural portion 37 includes a pair of earpieces 38 disposed on opposing adjustable arms 39.

To facilitate securing a stethoscope 32 in a convenient location about the garment 10, a pair of double pockets 40 are provided symmetrically disposed on an front upper portion of the garment 10. Preferably, one double pocket 40 is disposed on an upper portion of each front panel 14, 16, equidistantly spaced from a vertical centerline 42 of the garment and the neck opening 22. The spacing of each double pocket 40 from the neck opening 22 and the vertical centerline 42 is selected such that opposite ends of a stethoscope 32 centrally placed around a wearer's neck would naturally come to rest in, and occupy a substantial portion of each double pocket 40, as best seen in FIG. 1.

Figure 3A:
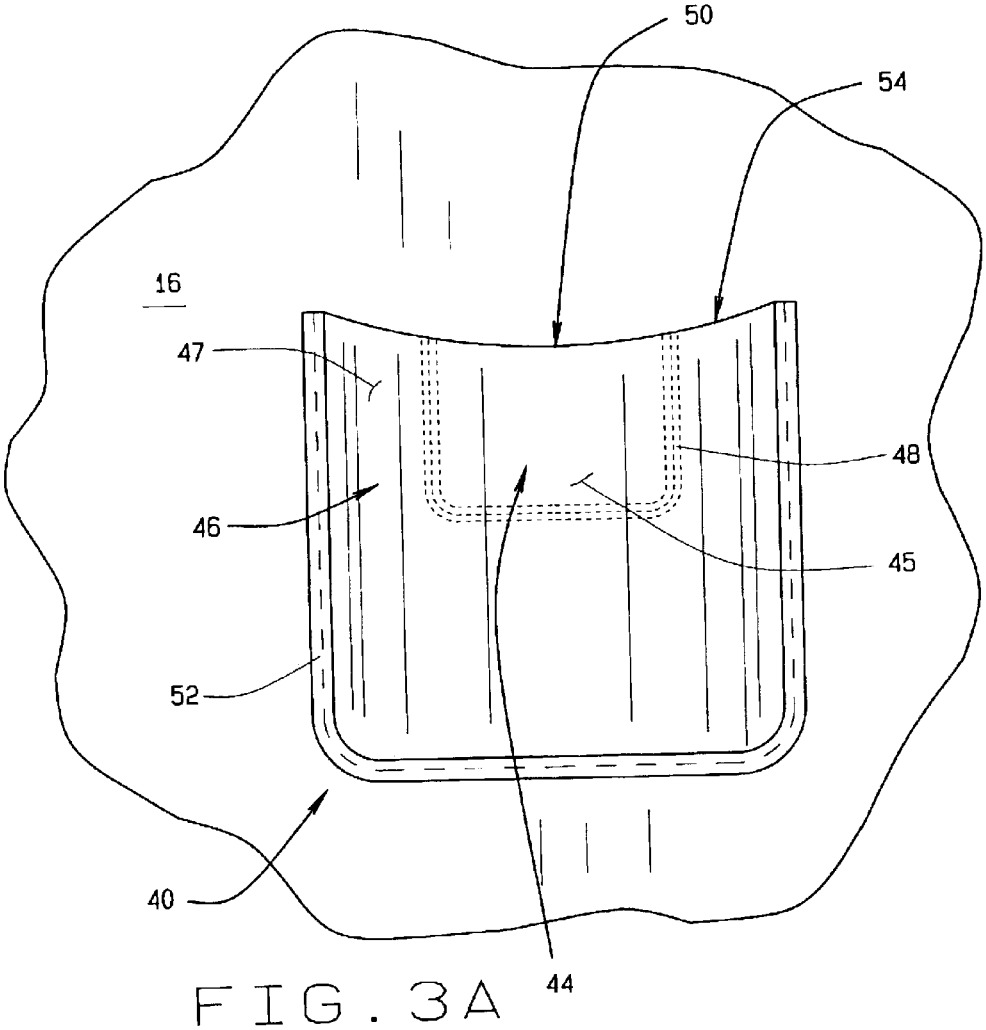
FIG. 3A is an enlarged front view of a double pocket on the garment of FIG. 1.
Figure 3B:
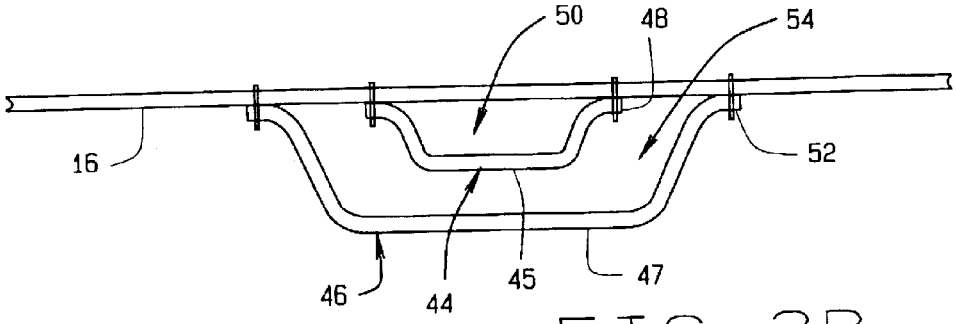
FIG. 3B is a top sectional view of the double pocket of FIG. 3A.

Preferably, in a first embodiment, each double pocket 40 consists of an small pocket 44 disposed within an large pocket 46 as shown in FIGS. 3A and 3B. Each small pocket 44 is composed of a layer of material 45 secured in a conventional manner, such as by stitching, to a corresponding front panel 14, 16 about a portion of a perimeter 48, leaving an opening 50, and is sized to receive a chest piece 34 of the stethoscope 32. Each large pocket 46 is similarly composed of a layer of material 47 secured in a conventional manner, such as by stitching, to a corresponding front panel 14, 16 about a portion of a perimeter 52, leaving an opening 54, and is sized to receive a binaural portion 37 of the stethoscope 32. Preferably, opening 50 and opening 54 are horizontally aligned. The secured perimeter 52 of each large pocket 46 is outwardly spaced from the secured perimeter 48 of a corresponding small pocket 44, such that the small pocket 44 is effectively disposed within the enclosure defined by the large pocket 46.

Figure 4A:
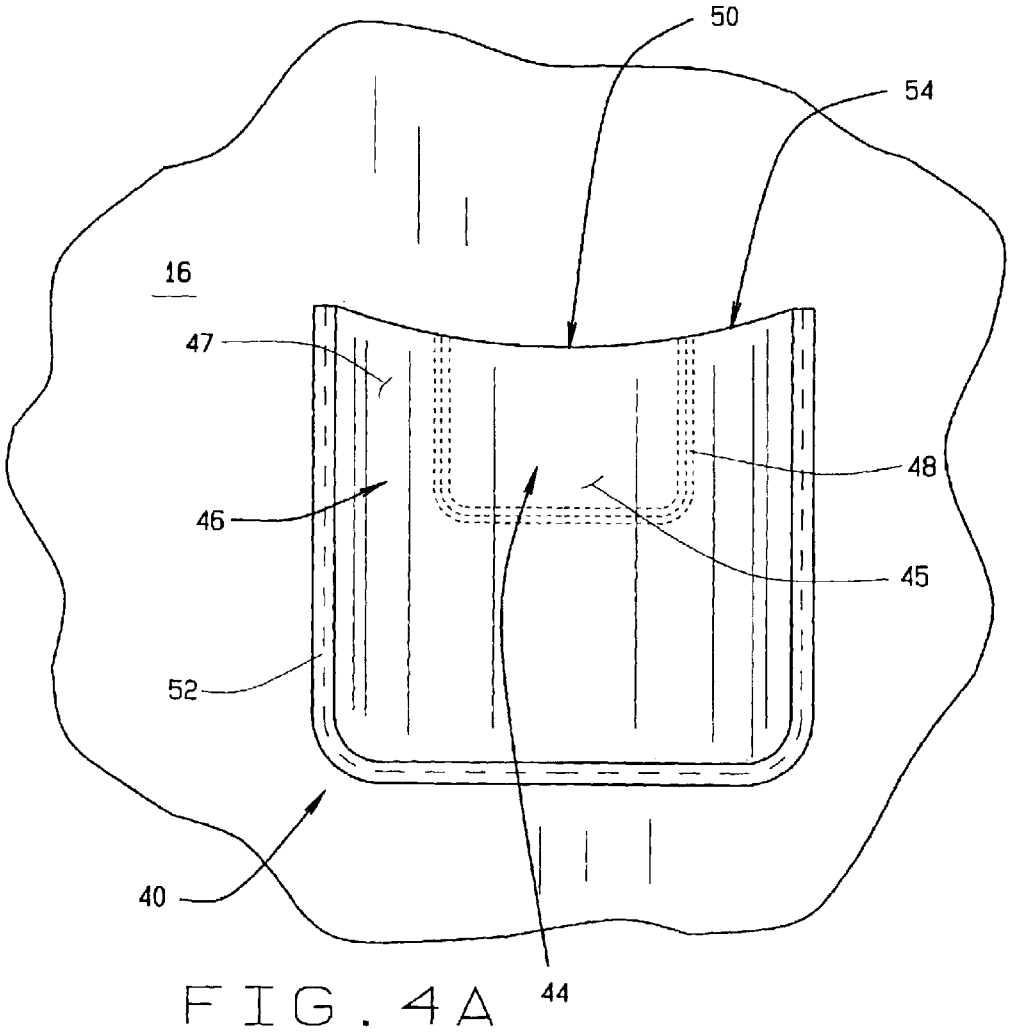
FIG. 4A is an enlarged front view of a first alternate double pocket on the garment of FIG. 1.
Figure 4B:
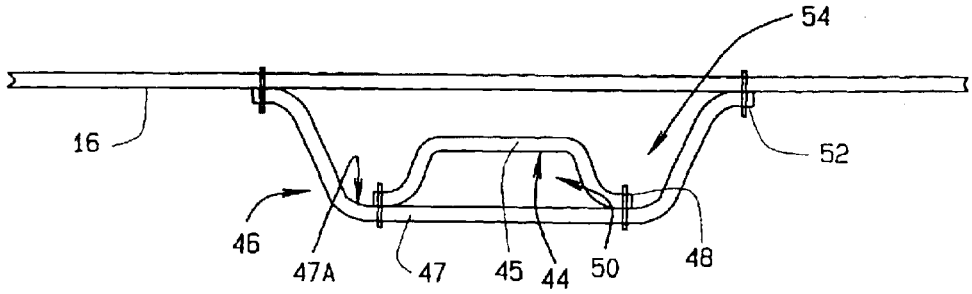
FIG. 4B is a top sectional view of the first alternate double pocket of FIG. 4A.

In one alternate embodiment, shown in FIGS. 4A and 4B, the material 45 of the small pocket 44 is secured to an inner surface 47A of the material 47 of the large pocket 46, such that the small pocket 44 is disposed within the large pocket 46.

Figure 5A:
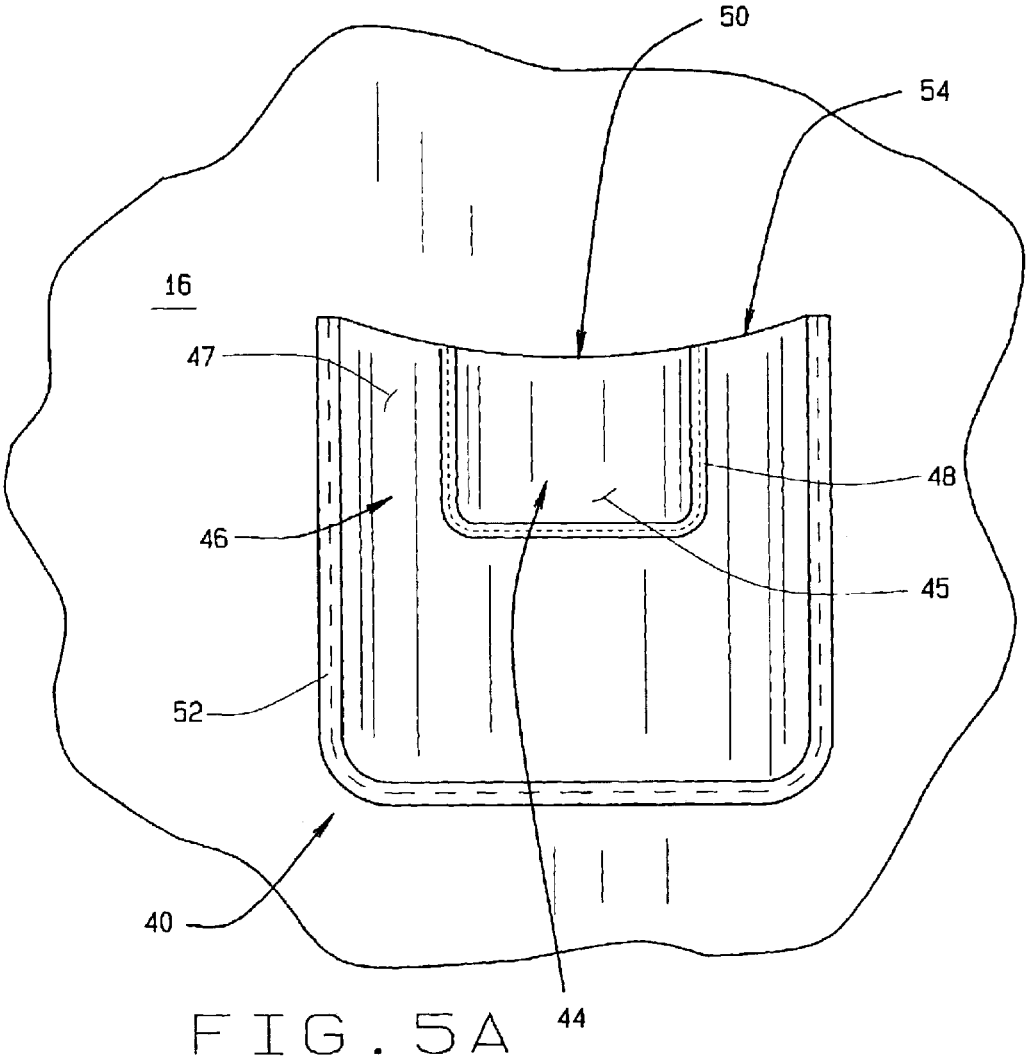
FIG. 5A is an enlarged front view of a first alternate double pocket on the garment of FIG. 1.
Figure 5B:
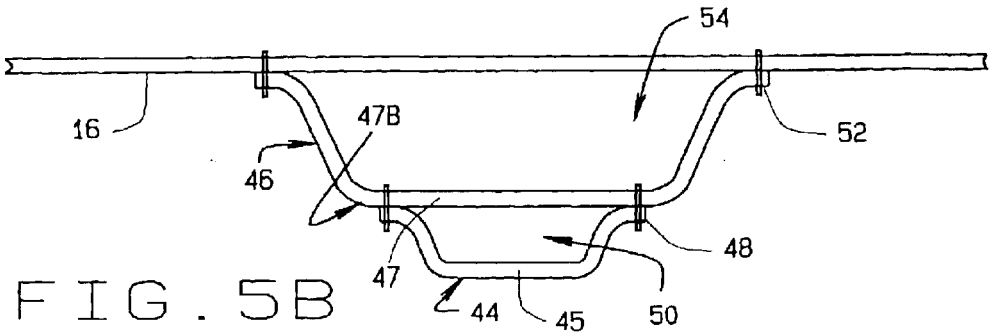
FIG. 5B is a top sectional view of the first alternate double pocket of FIG. 5A.

In a second alternate embodiment, shown in FIGS. 5A and 5B, the material 45 of the small pocket 44 is secured to an outer surface 47B of the material 47 of the large pocket 46, such that the small pocket 44 is disposed outside the large pocket 46.

Figure 6:
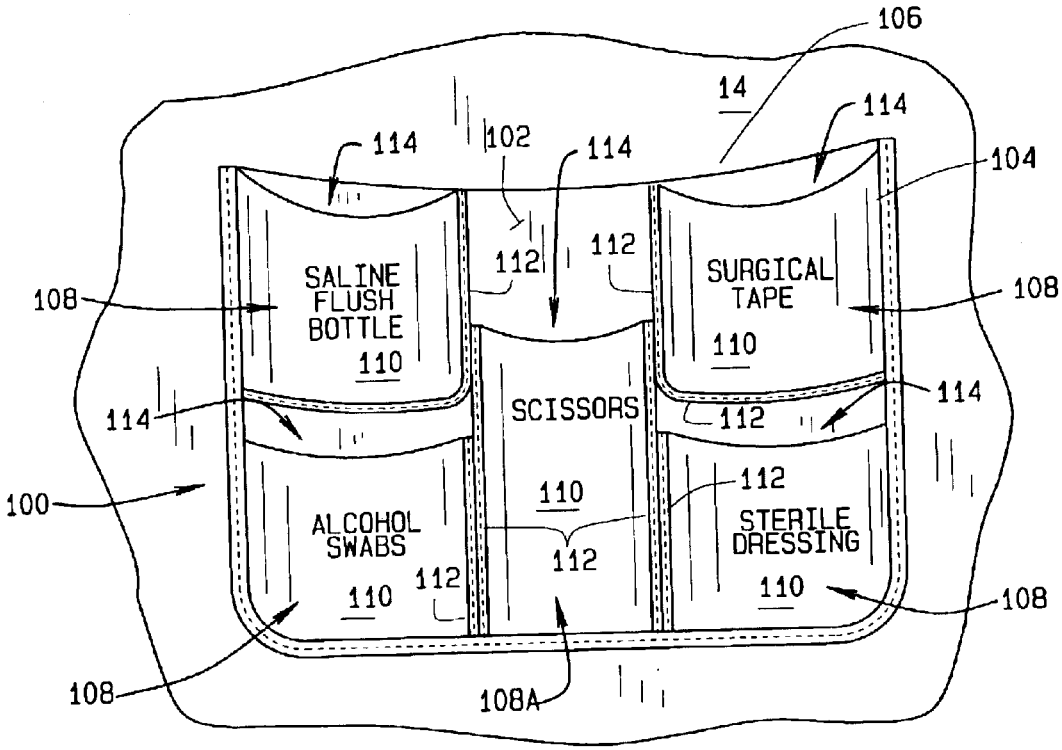
FIG. 6 is an enlarged front view of a first organizational pocket assembly on the garment of FIG. 1.
Figure 7:
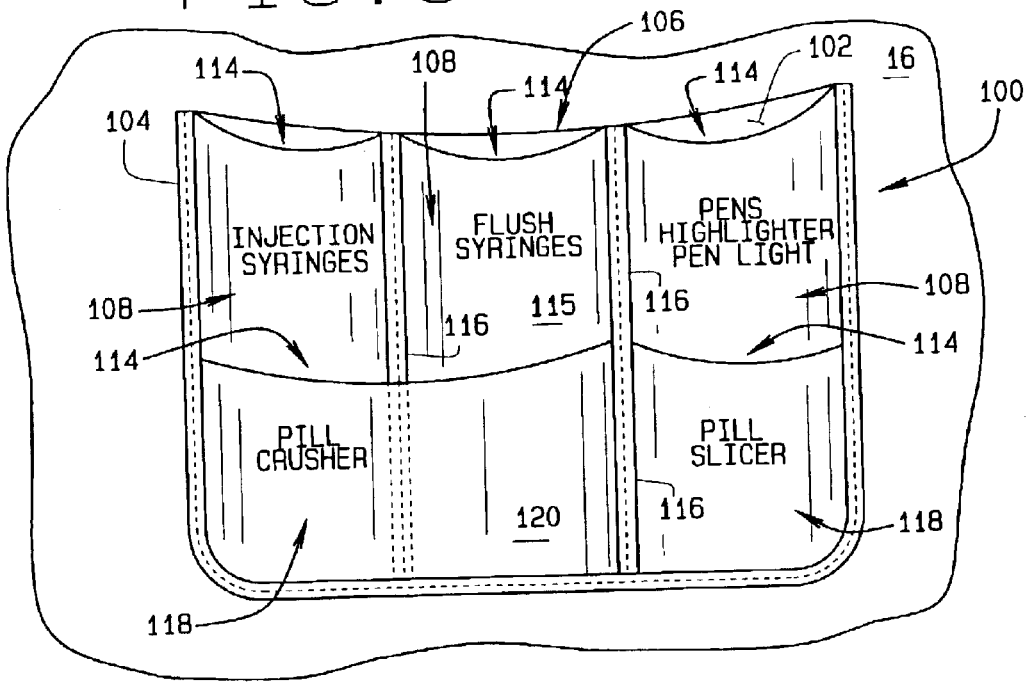
FIG. 7 is an enlarged front view of a second organizational pocket assembly on the garment of FIG. 1.

Turning to FIGS. 6 and 7, the upper body outerwear garment 10 of the present invention preferably includes at least one organizational pocket assembly 100 disposed on a front panel 14, 16. An organizational pocket assembly 100 preferably consists of a layer of material defining a front pocket panel 102 which is secured in a conventional manner, such as by stitching, to a corresponding front panel 14, 16 about a portion of a perimeter 104, leaving an article receiving opening 106. The front pocket panel 102 defines an enclosed pocket space which is preferably large enough to accommodate large items or a wearer's hands, for example, having a width of 10.0 inches, and a depth or height of 8.0 inches.

Each organizational pocket assembly 100 further includes at least one fitted pocket 108, preferably disposed on the outer surface of the front pocket panel. As shown in FIG. 6, each fitted pocket 108 may consist of a layer of material defining a fitted pocket panel 110 which is secured in a conventional manner, such as by stitching, to the front pocket panel 102 about a portion of a perimeter 112, leaving an article receiving opening 114.

Alternatively, as shown in FIG. 7, an organization pocket assembly 100 may include multiple adjacent fitted pockets 108 formed from of a common layer 115 of material which is secured in a conventional manner, such as by stitching, to the front pocket panel 102 about a portion of a perimeter 112, and along shared pocket divisions 116, leaving multiple article receiving openings 114. Further shown in FIG. 7 is an optional second layer of fitted pockets 118 disposed on the outer surface of the common layer 115. The second layer of fitted pockets 118 is formed from of a second common layer 120 of material which is secured in a conventional manner, such as by stitching, to the front pocket panel 102 about a portion of a perimeter 112, and along one or more of the shared pocket divisions 116 of the underlying common layer 115, leaving multiple article receiving openings 114. Those of ordinary skill in the art will recognize that the fitted pockets 118 may be disposed on either the outer face of the front pocket panel 102, or on the inner face of the front pocket panel, thereby effectively positioning each of the fitted pockets 118 within the large pocket defined by the front pocket panel 102.

Preferably, as shown in FIGS. 6 and 7, fitted pockets 108 and 118 are sized to receive specific health care consumable items which are frequently utilized by medical assistants. One or more vertically elongated fitted pockets, such as 108A, shown in FIG. 6, are sized to receive a pair of standard scissors. Other vertically elongated fitted pockets 108, shown in FIG. 7, are sized to receive injection syringes, flush syringes, pens, highlight markers, or pen lights. Fitted pockets 108 and 118 having a generally square configuration, such as seen in FIG. 6 are sized to receive saline flush bottles, prepackaged alcohol swab, sterile wound dressings, or surgical tape, and as seen in FIG. 7 for holding a conventional pill slicer. A horizontally elongated pocket, also seen in FIG. 7 is sized to receive a conventional pill crusher.

Preferably, as shown in FIGS. 6 and 7, each organizational pocket assembly 100 on the garment 10 is provided with fitted pockets for related health care consumables. For example, the organizational pocket assembly 100 shown in FIG. 6 is provided with fitted pockets for holding wound cleaning and dressing supplies. Correspondingly, the organizational pocket assembly 100 shown in FIG. 7 is provided with fitted pockets for holding patient examination and medication related items and health care consumable products. Configuring each organizational pocket assembly 100 with fitted pockets for related health care consumables permits a medical assistant to rapidly retrieve or store such items in a predetermined location, thereby facilitating access to needed items in emergency situations. Those of ordinary skill in the art will recognize that the groupings of fitted pockets in each organizational pocket assembly 100 may be altered from those described herein within the scope of the invention. For example, fitted pocket size and arrangement may be varied according to the specific health care consumable products or items which are to be logically grouped and stored in a pocket assembly 100.

Figure 8:
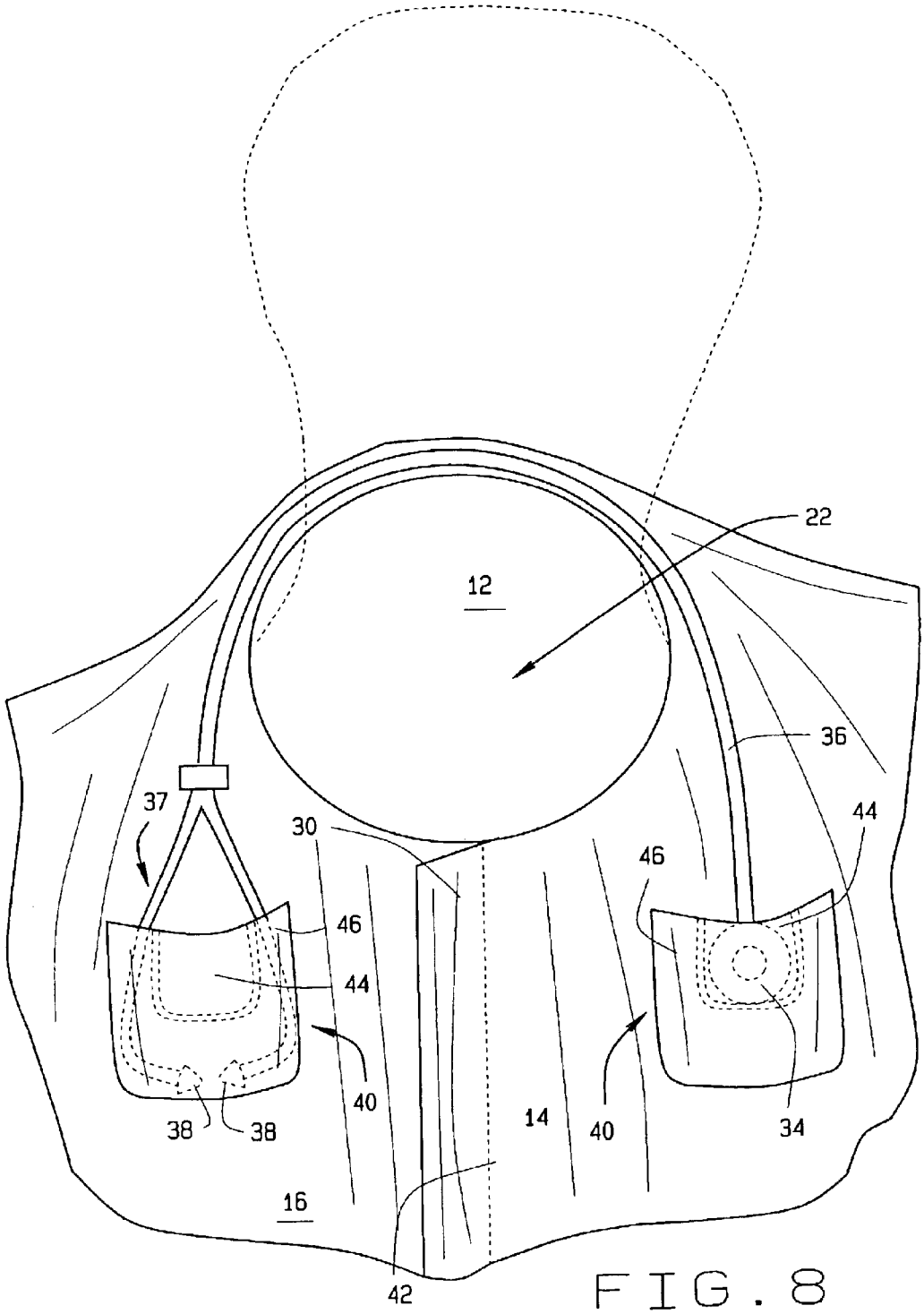
FIG. 8 is an partial view of the upper portion of the garment of FIG. 1, illustrating the storage of a stethoscope of FIG. 2.

Turning to FIG. 8, a method for using the garment 10 of the present invention to carrying a stethoscope 32 having a chest piece 34 and binaural portion 37 coupled by a length of flexible tubing 36 is illustrated. The method consists of initially draping the stethoscope 32 about a back portion of a wearer's neck. The stethoscope 32 is then adjusted such that the chest piece 34 and the binaural portion 37 lie adjacent the opposite double pockets 40 on the garment 10, and are substantially equidistant from the back portion of the wearer's neck. The binaural portion 37 is then placed in the adjacent large pocket 46, while the chest portion 34 is placed in the correspondingly adjacent small pocket 44. Preferably, once placed in the double pockets 40, either or both the binaural portion 37 or the chest piece 34 is supported in the respective pocket by the secured perimeter 48, 52. Supporting either or both the binaural portion 37 or the chest piece 34 within the double pockets 40 results in at least a portion of the weight of the stethoscope 32 being carried by the garment 10. As the garment 10 carries a portion of the weight of the stethoscope 32, the weight carried directly by the wearer's neck is correspondingly diminished, reducing associated fatigue and strain over time.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. An outerwear garment for use by medical personnel comprising:

an upper body covering portion including a back panel, a left front panel and a right front panel, a top neck opening, a left sleeve, and a right sleeve, said left front panel and said right front panel configured for selectively joining and disjoining;

a pair of double pockets, each double pocket having an small pocket sized to receive an chest piece end of a stethoscope, and a large pocket sized to receive an binaural portion of a stethoscope, a first double pocket of said pair of double pockets disposed on an upper portion of said left front panel, a second double pocket of said pair of double pockets disposed on an upper portion of said right front panel; each of said pair of double pockets equidistantly displaced from a garment centerline and said top neck opening.

2. The outerwear garment of claim 1 wherein, for each double pocket, said small pocket is contained within said large pocket of said.

3. The outerwear garment of claim 1 wherein, for each double pocket said small pocket includes a small pocket opening, said large pocket includes a large pocket opening, and said small pocket opening is aligned with said large pocket opening.

4. The outerwear garment of claim 1 wherein, for each double pocket, said small pocket is secured about a portion of an small pocket perimeter to said upper body covering portion, an unsecured portion of said small pocket perimeter defining an article receiving opening between an small pocket front surface and said upper body covering portion.

5. The outerwear garment of claim 1 wherein, for each double pocket, said small pocket is disposed on an outer surface of said large pocket.

6. The outerwear garment of claim 1 wherein, for each double pocket, said large pocket is secured about a portion of a large pocket perimeter to said upper body covering portion, an unsecured portion of said large pocket perimeter defining an article receiving opening between an large pocket front surface and said upper body covering portion.

7. The outerwear garment of claim 1 wherein said pair of double pockets are disposed on said outerwear garment such that an large pocket of a first of said pair of double pockets receives a binaural portion of a stethoscope, and an small pocket of a second of said pair of double pockets receives a chest piece of said stethoscope when said stethoscope is disposed about said top neck opening.

8. The outerwear garment of claim 1 further including:

at least one organizational pocket assembly disposed on said upper body covering portion, said at least one organizational pocket assembly having a front pocket panel defining a front surface, said front pocket panel secured about a portion of a perimeter to said upper body covering portion, an unsecured portion of said perimeter defining an article receiving opening between said front surface and said upper body covering portion, said at least one organizational pocket assembly further including a plurality of fitted pockets secured to said front surface.

9. The outerwear garment of claim 8 wherein at least one of said plurality of fitted pockets includes a vertically elongated configuration for retaining elongate objects for ready access.

10. The outerwear garment of claim 9 wherein at least one of said plurality of fitted pockets is configured to receive an elongated object from a set of elongated objects including syringes, scissors, pen lights, tongue depressors, and writing instruments.

11. The outerwear garment of claim 8 wherein at least one of said plurality of fitted pockets is configured to receive a health care consumable object from a set of health care consumable objects including alcohol swabs, surgical tape rolls, wound dressings, pill crushers, pill slicers, and saline flush bottles.

12. The outerwear garment of claim 8 wherein said plurality of fitted pockets secured to said front surface define one or more layers of fitted pockets.

13. The outerwear garment of claim 8 wherein said plurality of fitted pockets are configured to receive one or more health care consumables and products from a set of health care consumables and products commonly utilized by a medical assistant to provide wound care.

14. The outerwear garment of claim 13 wherein said set of health care consumables and products includes surgical tape, sterile dressings, scissors, alcohol swabs, and saline flush.

15. The outerwear garment of claim 8 wherein said plurality of fitted pockets are configured to receive one or more health care consumables and products from a set of health care consumables and products commonly utilized by a medical assistant to provide patient examination.

16. The outerwear garment of claim 15 wherein said set of health care consumables and products includes pens, highlight markers and pen lights.

17. The outerwear garment of claim 8 wherein said plurality of fitted pockets are configured to receive one or more health care consumables and products from a set of health care consumables and products commonly utilized by a medical assistant to dispense medications.

18. The outerwear garment of claim 17 wherein said set of health care consumables and products includes injection syringes, flush syringes, pill slicers, and pill crushers.

19. The outerwear garment of claim 8 wherein said plurality of fitted pockets are configured to receive one or more health care consumables and products in an organized array.

20. A method for carrying a stethoscope having a chest piece and binaural portion coupled by a length of flexible tubing, comprising the steps of:

draping the stethoscope about a back portion of a human neck;

adjusting the draped stethoscope such that the chest piece and the binaural portion are substantially equidistant from said back portion of said human neck;

supporting said binaural portion within a first garment pocket laterally disposed on a front of a garment;

supporting said chest piece within a second garment pocket laterally disposed on said front of said garment, vertically opposite from said first garment pocket; and wherein at least a portion of the weight of the stethoscope is carried by the first and second garment pockets.

* * * * *